United States Patent [19]

Williams

[11] 4,212,382

[45] Jul. 15, 1980

[54] BUNKERING SYSTEM

[75] Inventor: Morgan J. Williams, Melbourne, England

[73] Assignee: Coal Industry (Patents) Limited, London, England

[21] Appl. No.: 916,750

[22] Filed: Jun. 19, 1978

[30] Foreign Application Priority Data

Jun. 21, 1977 [GB] United Kingdom ..... 25774/77

[51] Int. Cl.[2] ..... B65G 43/08

[52] U.S. Cl. ..... 198/502; 198/505

[58] Field of Search ..... 198/347, 502, 504, 505, 198/530, 531, 532, 534, 571, 572, 524; 222/55, 290, 408; 299/18

[56] References Cited

U.S. PATENT DOCUMENTS

| | | | |
|---|---|---|---|
| 1,647,704 | 11/1927 | Lea | 198/502 |
| 2,083,391 | 6/1937 | Murray | 198/505 X |
| 2,343,722 | 3/1944 | Wagner | 222/55 |
| 3,064,357 | 11/1962 | Butters | 198/502 X |

FOREIGN PATENT DOCUMENTS

| | | | |
|---|---|---|---|
| 1205901 | 11/1965 | Fed. Rep. of Germany | 198/505 |

*Primary Examiner*—James L. Rowland

*Attorney, Agent, or Firm*—Stevens, Davis, Miller & Mosher

[57] ABSTRACT

The device comprises a variable height metering door located over a conveyor used to remove material from a bunker. The door is pivotable, so that rogue material such as pit props may pass it, and is movable up and down relative to the conveyor, so that the depth of material on the conveyor is variable. The door may be moved by moving a frame on which it is mounted, for instance by use of hydraulic or pneumatic rams or a turnbuckle. The height of the door above the conveyor may be determined in response to signals received from sensors associated with the bunkering system.

4 Claims, 4 Drawing Figures

BUNKERING SYSTEM

This invention relates to a device for use in a bunkering system, and particularly, but not exclusively, relates to a device for use in a coal bunkering system.

In many instances in which discrete material is stored and transported, for instance in a coal bunkering system, it is desired to ensure that material is transported from a given point at a given rate, even though the supply of material to the given point is intermittent or variable. It is presently the practice to provide at the point a storage bunker for use either to store excess material arriving at the point or to augment the supply from the point if the supply to the point is deficient.

The material is usually transported from the point on a conveyor belt, and the rate at which the material is transported is regulated by a metering door. The door is located in spaced relation above the belt and in normal use remains closed, thus ensuring that a bed of material of a fixed depth can be transported out of the bunker on the belt thus ensuring a steady rate of transport of material.

The door is biased to remain in the closed position in normal use. However if any "rogue" material, that is material which is large enough to become jammed between the door and the conveyor belt, is transported to the door, the door is opened against the bias to let the rogue material through, and then closes to return to its normal operative position. This prevents any jamming which would alter the rate at which the material is transported.

In a mining installation the rogue material may comprise a large piece of mined mineral matter, or a pit prop or girder which has accidentally become mixed with the mineral matter.

The door may comprise a single flap door which is pivoted about a horizontal axis transverse to the flow of material, although this type of door has a tendency to remain open even when no rogue material is being transported past it. Alternatively the door may comprise a double flap door, having each flap pivoted about a vertical axis transverse to the flow of material, the two flaps when closed forming a V-shaped barrier having its apex downstream of its pivot mountings.

The major problem with the presently used bunkering systems is that the rate at which the material is transported from the point can only be varied either by varying the speed of the conveyor belt, or by removing one door and replacing it with another of a different size, which gives a different clearance between its bottom and the conveyor belt. The latter method still has the disadvantage that only certain discrete rates of transport are possible, and these depend on the number of available door sizes.

It is an object of the present invention to provide a device which, at least in part, overcomes the above mentioned disadvantages.

Therefore, according to the present invention a device, to be used in a bunkering system including a drivable conveyor adapted to remove material from a bunker, comprises a pivotally mounted metering door biased to remain closed, the pivot mounting being movable up and down relative to the conveyor thereby to vary the clearance between the bottom of the door and the conveyor, and a means which gives an indication of the clearance.

The door may be either a single- or double-flap door, and is preferably mounted on a frame which is movable by one or more fluid or electrically operable rams. Conveniently there is also provided a means by which the doors may be movable manually, for instance a turnbuckle. The manually operable means may also be the only means of moving the frame.

Conveniently the or each ram is mounted so that it does not project above the normal height of the bunkering system. This may be achieved by connecting the or each ram to the frame through a lever or toggle system. Such an arrangement is preferred if the device is to be used in a confined space, for instance below ground in a mineral mining installation.

Preferably the door is biased to remain closed by gravity through a pulley and weights system, although the use of springs or other biasing means is within the scope of the invention.

The frame may be movable in a channel shaped member or along an I-section rail. The frame may also be constrained to move up and down relative to the conveyor by any other convenient means.

The indicating means may comprise simple scale and pointer, the scale being fixed relative to the conveyor and the pointer being fixed relative to the frame, or vice versa. Preferably, the means is an electronic sensor connected to a read-out means and responsive to the movement of one part of the device. For instance, the sensor may be a variable resistance, responsive to the extension of a ram, or to the rotation of a part of a lever system.

The electronic sensor is preferably connected to a remote control system from which it is possible to control all aspects of a bunkering system, including the device according to the invention. Preferably the control system also includes a material sensor located in the bunker, the height of which sensor above the bunker floor is variable by the movement of the frame. This sensor can therefore sense whether or not there is enough material in the bunker to fill the conveyor to the desired capacity.

In use, the frame is moved up or down to give a desired clearance between the conveying member of the conveyor and the bottom of the door. This ensures that in normal operation a bed of material of substantially constant depth will be transported out of the bunker on the conveyor, thus ensuring, assuming the material itself has fairly constant properties, that there is a constant rate of material transport from the bunker. The device will only be able to regulate the rate of transport if the bunker contains sufficient material to satisfy the demand of the conveyor.

Preferably the conveyor incorporates, or leads onto, a weighing device which may be used to check the operation of the device according to the invention.

Although it is envisaged that the device will have particular application to the coal mining industry, it is in no way limited to such use, and may be used in any other mineral mining industry, or in the transport of grain or particulate chemicals.

The invention will now be described, by way or example only, with reference to the accompanying drawings, in which.

Figure 1:
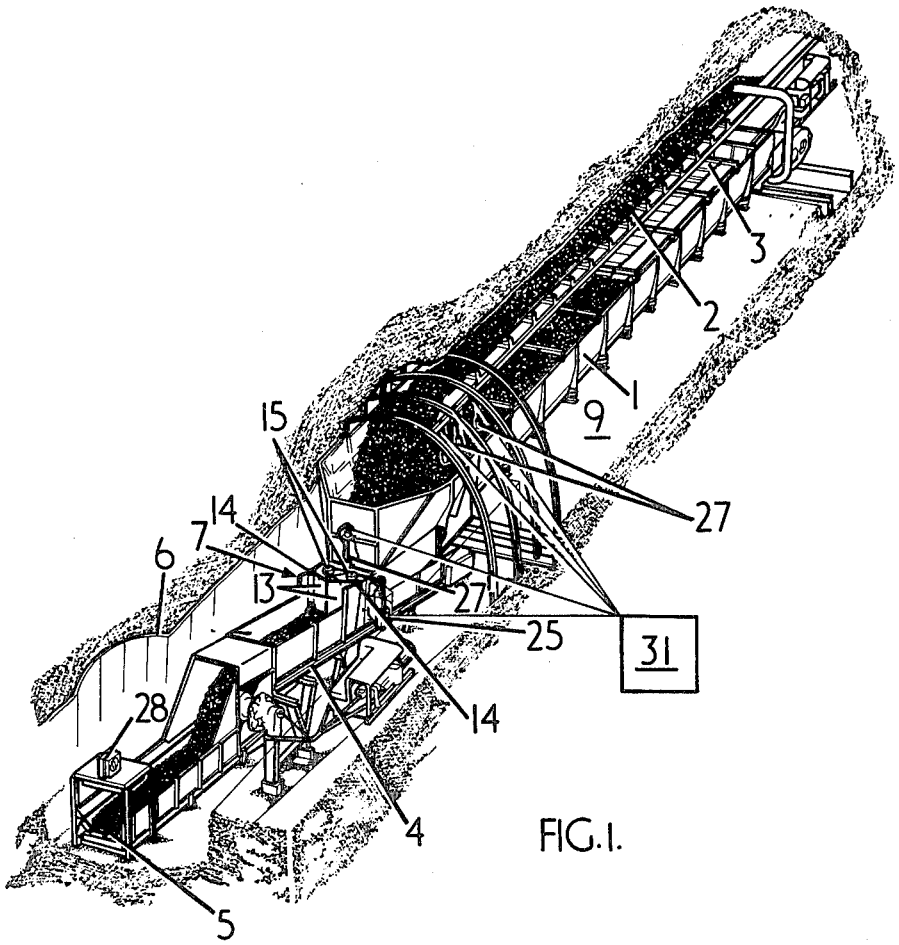
FIG. 1 shows a cut-away perspective view of part of a coal bunkering system, including a device according to the invention.

Referring now to FIG. 1, the coal bunkering system comprises a storage bunker 1, having an inflow conveyor 2, a stacking conveyor 3, an outflow conveyor 4, a weighing conveyor 5 including a weighing scale 28 and sensors 27. The bunkering system is shown located in a mine roadway 6 on the roadway floor 9. Coal is mined at a remote location (not shown) and is transported from the remote location to the bunker 1 on inflow conveyor 2. Coal is removed from the bunker 1 on the outflow conveyor 4, and the rate at which it is removed is regulated by device 7 (shown diagrammatically in FIG. 1).

If there is a build-up of coal on the outflow conveyor 4, the stacking conveyor 3 is actuated to move the excess coal into the bunker 1. If there is not enough coal on the outflow conveyor 4, the stacking conveyor 3 is actuated in the opposite direction to move bunkered coal onto the outflow conveyor 4. The amount of coal in the bunker 1 and on the conveyors 2 to 5 is monitored by means of sensors 27 which are linked to a remote control system 31. One, 27′, of the sensors 27 is connected to the frame 12 (see later) of the device 7 by a pulley system (not shown) and moves up and down with the frame 12. The sensor 27′ indicates to the control system whether or not there is enough coal in the bunker 1 to fill the outflow conveyor 4 to the capacity set by the device 7. The outflow conveyor 4 transports coal at a rate set by device 7 onto the weighing conveyor 5, which transports the coal to its destination.

During a mining operation coal is produced intermittently, especially if coal is mined from a mechanized face. The mining machinery when operating normally can mine large amounts of coal, and up to 800 tons per hour may be fed into the bunker 1 on the inflow conveyor 2. However the flow is reduced to nothing when the machinery is not operating. The machinery may be stopped for many reasons, for instance to replace worn picks, or to advance the roadway or roof supports. The outflow conveyor 4 normally operates at a flow rate of about 400 tons per hour. It can therefore easily be seen why it is necessary to have a bunkering facility between the inflow conveyor 2 and the outflow conveyor 4.

The rate at which coal is transported out of the bunker 1 is dependent on the speed of the outflow conveyor 4 and the depth of the coal thereon. The latter is controlled by the device 7, which is shown in more detail in FIGS. 2, 3 and 4, to which reference is now also made.

The device 7 comprises two vertical side plates 8 fixed on either side of the outflow conveyor 4, each plate 8 having formed in it a channel 10 running up the middle and extending beyond the top of the main part of the plate 8, the opening of each channel 10 facing towards the conveyor. A vertical T-shaped slot 11 is provided in each channel 10.

A frame 12 is slidable within the channels 10, and two flaps 13 are pivotally mounted at 14 on arms 24 of the frame 12, the arms being fitted into the channels 10. Each flap 13 is mounted so that it can pivot about the longitudinal axis of the arm 24 on which it is mounted. The flaps 13 meet above the outflow conveyor 4 downstream of the pivot mountings 14 and are biased to remain together by a pulley 15 and weights 25 system. The flaps 13 form a door which is located in spaced relation above the outflow conveyor 4.

A connecting pin 16 is fixed in each of the arms 24 and extends though the slot 11 in the channel 10. Each pin 16 is pivotally connected to one end of a link 17, which has at its other end a fork which is pivotally connected to one end of an arm 18. The arm 18 is pivotally mounted at its other end on a horizontal shaft 19 which extends through both the side plates 8 and is supported by bearings 20 in the side plates.

A hydraulically-powered double-action ram 21 is pivotally mounted on each of the side plates 8, on mounting plates 22, and each ram 21 has its piston rod 23 pivotally connected to the arm 18, between the ends thereof.

Height sensors 30 in the form of linear potentiometers are fitted inside the hydraulic ram 21 and are adapted to give a signal proportional to the extension of the piston rod 23 from the ram 21.

In alternative arrangements for height sensors, a linear potentiometer may be pivotally connected between the side plate 8 and the arm 18, or a rotaty potentiometer may be fitted on the shaft 19 and respond to the angular movement of the arm 18 about the shaft 19.

In the present case the double-action ram 21 is detachable and replacable by a turnbuckle (not shown) which can be used to raise and lower the flaps 13 manually. This is very useful in the event of breakage of the ram 21 or of power failure in the hydraulic system for the ram 21.

Figure 2:
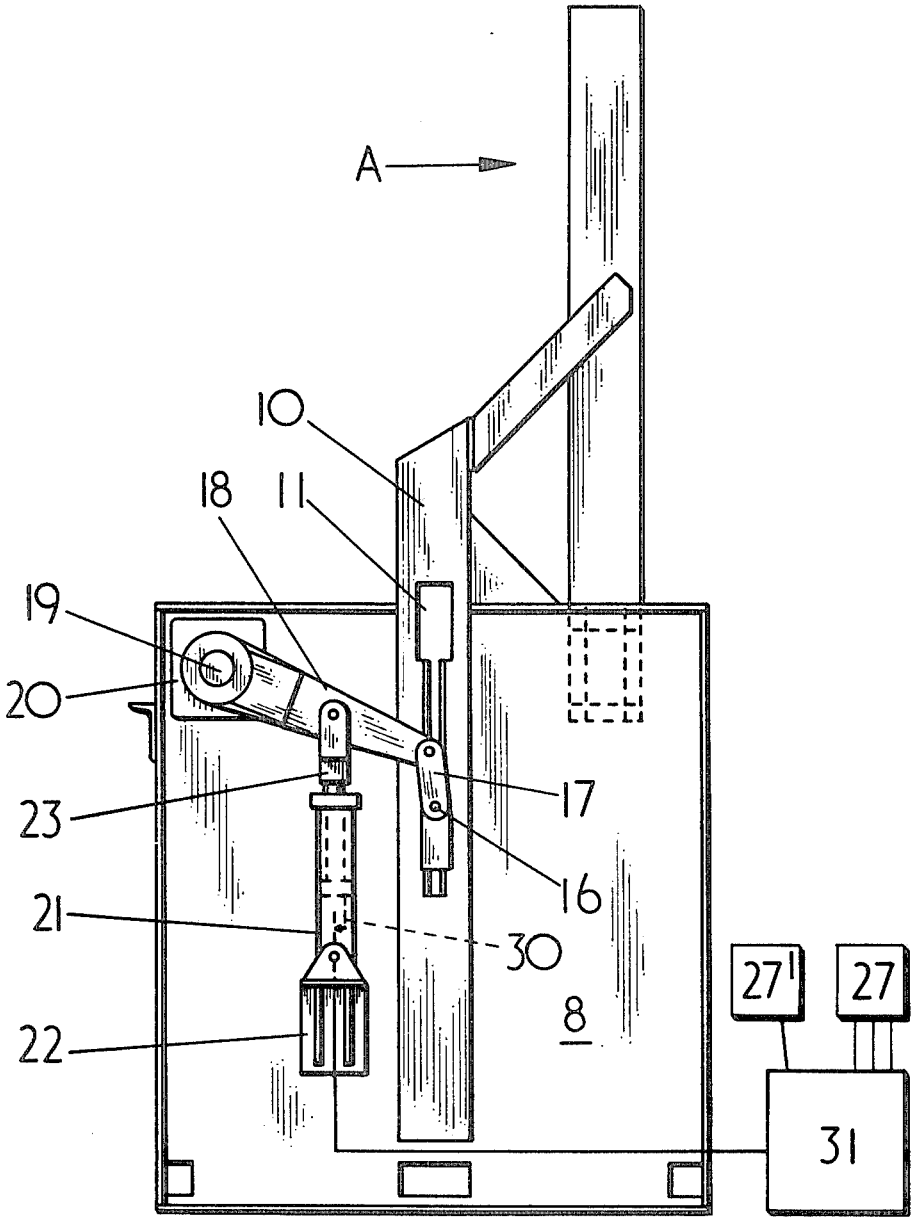
FIG. 2 shows a side view of the device of FIG. 1.
Figure 3:
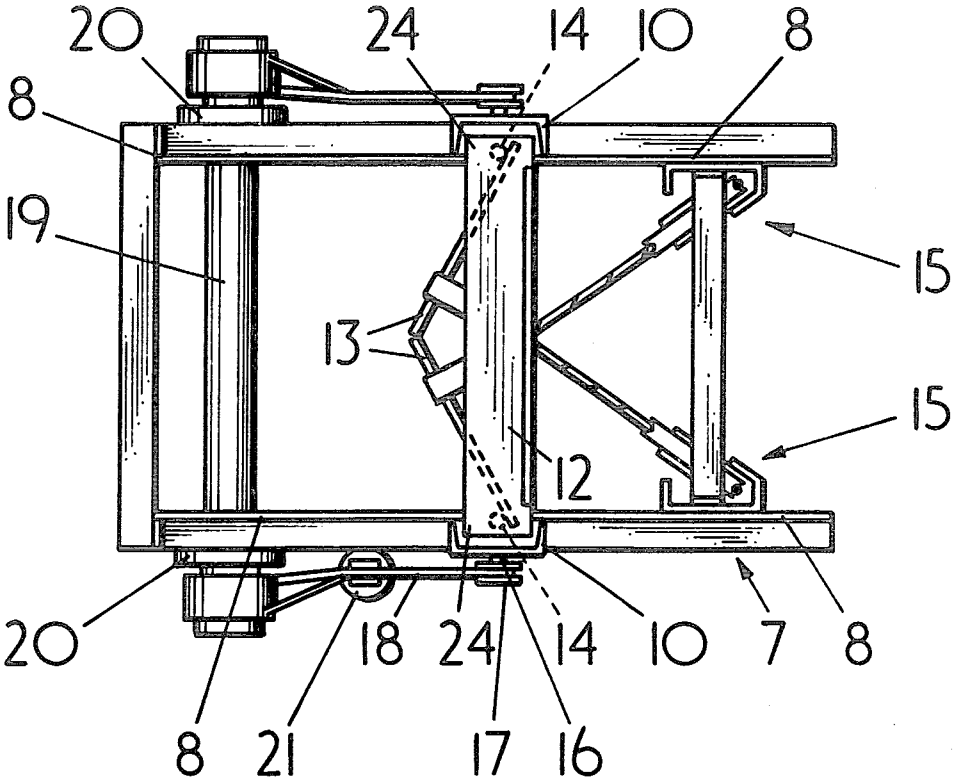
FIG. 3 shows a plan view of the device of FIG. 1.
Figure 4:
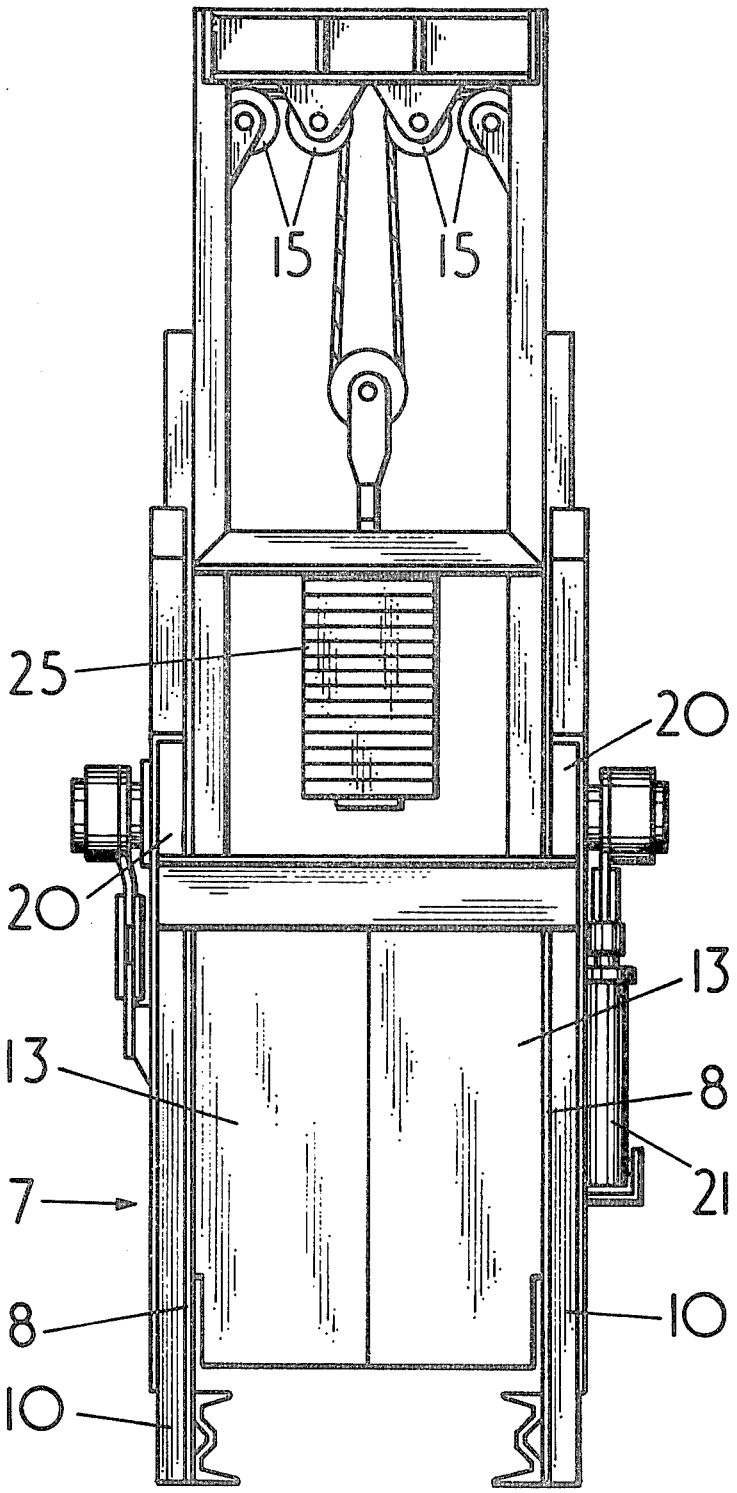
FIG. 4 shows an end view of the device of FIG. 1 looking in the direction of arrow A of FIG. 2.

In the arrangement shown in FIGS. 2 and 3 the ram 21 is fully retracted and the bottoms of the flaps 13 are as near as they can be, in normal operation, to the outflow conveyor 4. Thus, in use, the minimum depth of coal on the conveyor can flow out of the bunker 1. The device 7 is used in the following way to vary the rate of flow of coal from the bunker 1.

The ram 21 is actuated to extend the piston rod 23. This causes the arm 18 to pivot counterclockwise (as shown in FIG. 2) about the shaft 19, and this in turn causes the frame 12 and therefore the flaps 13 to move upwards, thus increasing the clearance between the bottom of the flap 13 and the outflow conveyor 4 and allowing a greater depth of coal to pass under the door. As the flaps 13 move upwards so too does the sensor 27′. If the sensor 27′ is moved by this action out of the coal in the bunker 1, a signal is received by the control system 31 which may then take appropriate action, which may for instance be to activate the stacking conveyor 3 to move coal in the bunker 1 towards the outflow conveyor 4.

To decrease the rate of flow of coal out of the bunker 1, the ram is actuated to retract the piston rod 23, causing the reverse effect.

The height sensor 30, in use, is connected to the remote control system 31. An operator (not shown) at the control system 31 or a computer (not shown) connected to the control system 31 processes the signals obtained from both the sensors 27 and the height sensor 30 and can then control the operation of the ram 21 and the conveyors 2 to 5 to ensure that a substantially constant rate of flow of coal out of the bunker 1 is maintained, or to vary the rate of flow as dictated by demand downstream of the device 7.

If, in use, a rogue piece of material is transported onto the outflow conveyor 4 the rogue will force the flaps 13 to part, against the gravity bias of the weights 25 which will move upwards. As soon as the rogue material has passed the flaps 13, the weights 25 will move downwards, closing the flaps 13 so that they again form a metering door.

As can be seen from the above description the device according to the invention allows the rate of flow of coal from a bunker to be varied continuously in response to varying supply and demand conditions upstream and downstream of the device respectively. The device occupies no more space then normal metering doors, is very difficult to jam, may be controlled remotely and/or automatically, and may, if necessary be operated manually.

I claim:

1. A device, to be used in a bunkering system including a drivable conveyor adapted to remove material from a bunker, comprising a pivotally mounted metering door mounted in a pivotal mounting and biased to remain closed, at least one fluid operable ram for moving the pivotal mounting up and down relative to the conveyor thereby to vary the clearance between the bottom of the door and the conveyor, and an indicating means which gives an indication of the clearance.

2. A device according to claim 1, wherein the indicating means comprises a variable resistance responsive to the extension of the at least one ram.

3. A device according to claim 2, wherein the variable resistance is connected to a remote control system.

4. A device according to claim 3, and including a variable height bunker sensor connected to the remote control system.

* * * * *